US008539703B2

(12) United States Patent
DeMarco

(10) Patent No.: US 8,539,703 B2
(45) Date of Patent: Sep. 24, 2013

(54) ADVERTISING DISPLAY

(76) Inventor: Vincent M. DeMarco, Orange, CA (US)

( * ) Notice: Subject to any disclaimer, the term of this patent is extended or adjusted under 35 U.S.C. 154(b) by 35 days.

(21) Appl. No.: 13/274,135

(22) Filed: Oct. 14, 2011

(65) Prior Publication Data

US 2013/0008067 A1 Jan. 10, 2013

Related U.S. Application Data

(60) Provisional application No. 61/505,237, filed on Jul. 7, 2011.

(51) Int. Cl.
*G09F 15/02* (2006.01)

(52) U.S. Cl.
USPC ..... 40/607.12

(58) Field of Classification Search
USPC ..... 40/607.01, 606.12, 606.13
See application file for complete search history.

(56) References Cited

U.S. PATENT DOCUMENTS

| | | | | |
|---|---|---|---|---|
| 786,481 | A * | 4/1905 | Burdick | 40/607.11 |
| 991,136 | A | 3/1911 | Chesley | |
| 1,454,691 | A | 5/1921 | Riddell et al. | |
| 2,157,199 | A | 1/1937 | Doering | |
| 2,803,901 | A | 8/1957 | Lane | |
| 2,899,765 | A | 8/1959 | Fuller | |
| 3,341,958 | A | 9/1967 | Pardue | |
| 3,691,663 | A | 9/1972 | Caven et al. | |
| 5,572,816 | A | 11/1996 | Anderson, Jr. et al. | |
| 2009/0283659 | A1 | 11/2009 | Newbill | |

FOREIGN PATENT DOCUMENTS

| | | | |
|---|---|---|---|
| AT | 411 113 | B | 9/2003 |
| DE | 41 32 357 | A1 | 4/1993 |
| DE | 10 2009 049472 | A1 | 4/2011 |
| WO | 92 20057 | A1 | 11/1992 |

OTHER PUBLICATIONS

PCT International Search Report, PCT/US2012/044876, Aug. 31, 2012.
Written Opinion of International Searching Authority, PCT/US2012/044876.

* cited by examiner

*Primary Examiner* — Casandra Davis
(74) *Attorney, Agent, or Firm* — Scott R. Hansen; Fulwider Patton LLP

(57) ABSTRACT

An advertising display has support structures that attach to a pole. One or more advertising panels are mounted on the support structures to form an advertising display. The display may have the form of a cylinder, a triangle, a rectangle, an oval or other shapes. The display may optionally be tapered. The support structures may have a variety of score lines, at which the support may be folded as appropriate for the particular diameter of the pole. The panels may be secured to the supports by way of clips or other mechanical fasteners. Double-sided adhesive may be employed to secure ends of the panels, as desired.

18 Claims, 22 Drawing Sheets

FIG. A

ADVERTISING DISPLAY

RELATED APPLICATIONS

This application claims the benefit of U.S. Provisional Patent Application No. 61/505,237, entitled "Cylindrical Advertising Display," filed Jul. 7, 2011, and which is hereby incorporated by reference in its entirety.

BACKGROUND

In the field of advertising, it is common to display posters, signs and other generally flat advertising media. These are often posted to walls, or allowed to hang downwardly from supports. The present invention presents a novel approach to providing a non-flat advertising medium that is supported by a central primary support, such as a lamp post, a tree or other common support.

SUMMARY OF THE INVENTION

An advertising display system for mounting on a primary support, such as a pole, post or the like, has at least one display support. The number of display supports may depend on the shape of the advertising display, for example, the size or other factors.

In one embodiment the display system includes a first display support and at least a second display support, as well as at least one flexible, adjustable tie to secure the first and second supports to the primary support. The system also includes an advertising panel, the advertising panel mounted on and secured to the first and second display supports and extending around the primary support. The display supports space the advertising panel a distance from the primary support, each display support being formed from a sheet of material and being foldable in a folding area of the display support, each display support having a plurality of markings to indicate fold lines to accommodate a variety of primary support sizes.

Various embodiments of the present inventions may include particular features. For instance, the display supports may include markings which may be, for example, printed marks or lines, fold lines, score lines, or the like. The advertising panel extends about the display supports to form a cylindrical advertising display. In alternative embodiments, the advertising panel may be oval, or may include a plurality of sub-displays, to form triangular or rectangular displays. The triangular display embodiment, for example, may include additional display supports, such as three display supports. Similarly, an embodiment for a rectangular display may include four display supports.

The advertising panel and the panel supports may be made from a variety of materials, including a polyvinyl chloride (pvc), cardboard or other sturdy, printable material. In one embodiment, the advertising panel and supports are formed from the same sheet material, although the panel supports may alternatively be formed from a different material than the advertising panel.

The system may further include fasteners for fastening the advertising panel to the display supports, such as screws, bolts and nuts, Viking clips, other mechanical fasteners, adhesive, heat bonding, and/or other securing methods known in the art. Adhesive or mechanical fastening means may be used to secure a first end of an advertising panel to a second end of the advertising panel.

Visual information, such as text and/or graphics, may be printed on the advertising panel. The information is preprinted in most embodiments. In some embodiments, the advertising panel is tapered, having a wider dimension on one end and a narrower dimension on an opposite end. Correspondingly, at least one display support may be tapered in this embodiment, having a wider dimension on one end and a narrower dimension on an opposite end.

The foregoing is merely exemplary. Additional features and aspects of the invention may be found in the Detailed Description and Drawings, for example. Consequently, the present invention is not limited by this Summary but should be interpreted in the broader context of the Detailed Description, Drawings and Claims.

DESCRIPTION OF A PREFERRED EMBODIMENT OF THE INVENTION

Figure 1:
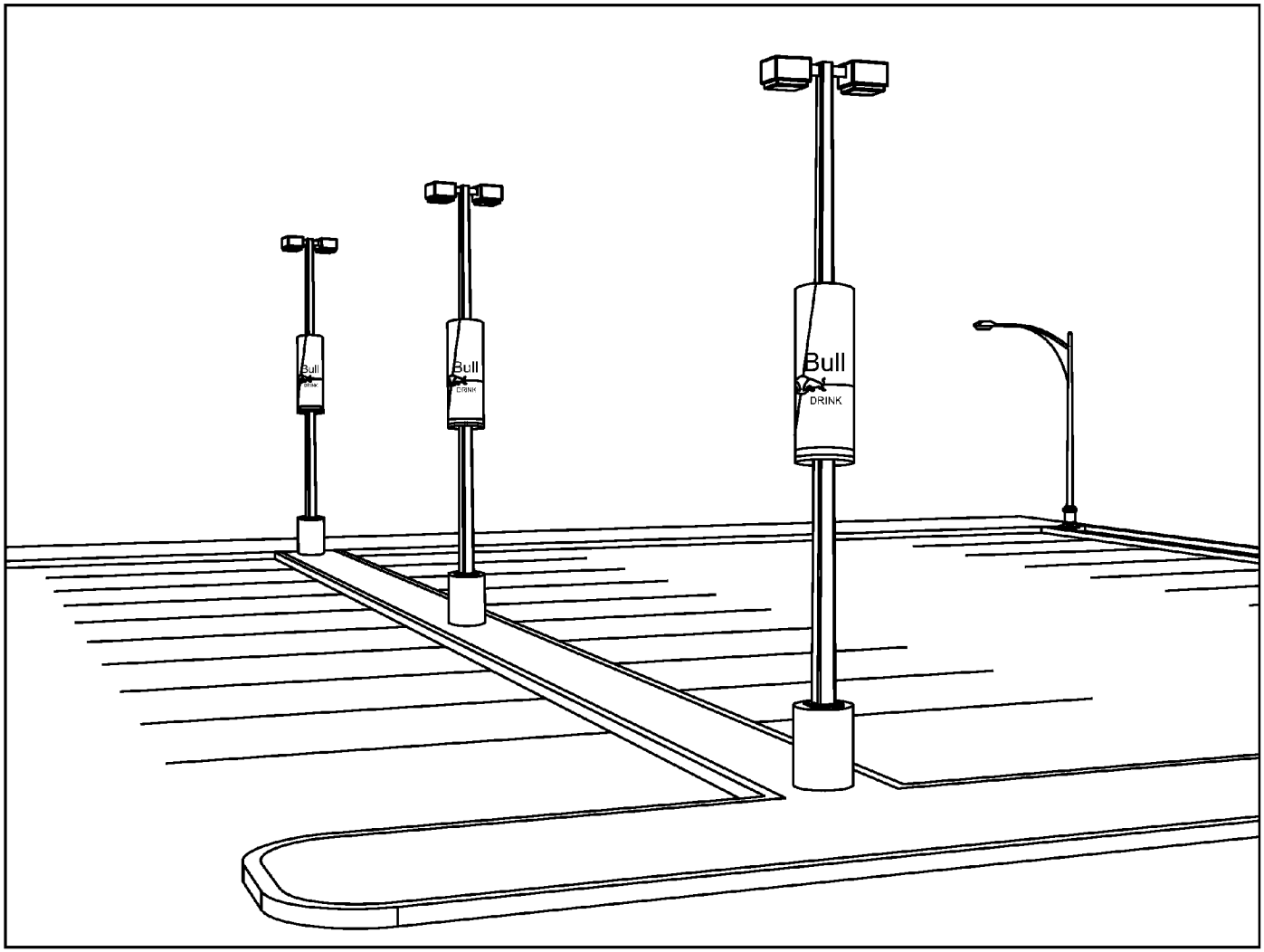
FIG. 1 illustrates one embodiment of an array of advertising displays according to the present invention, in this case advertising displays secured to lamp posts in a parking lot.
Figure 2A:
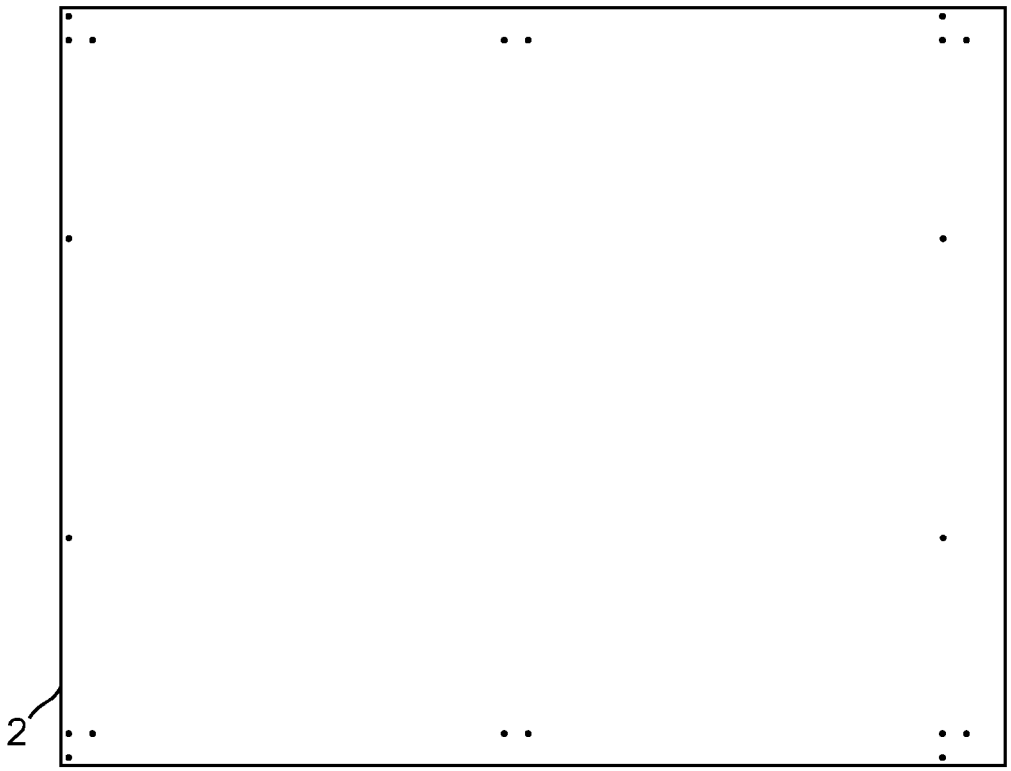
FIGS. 2A-2D illustrates diagrams of flat printed sheets according to the present invention, as well as side views of sample support structures.
Figure 2B:
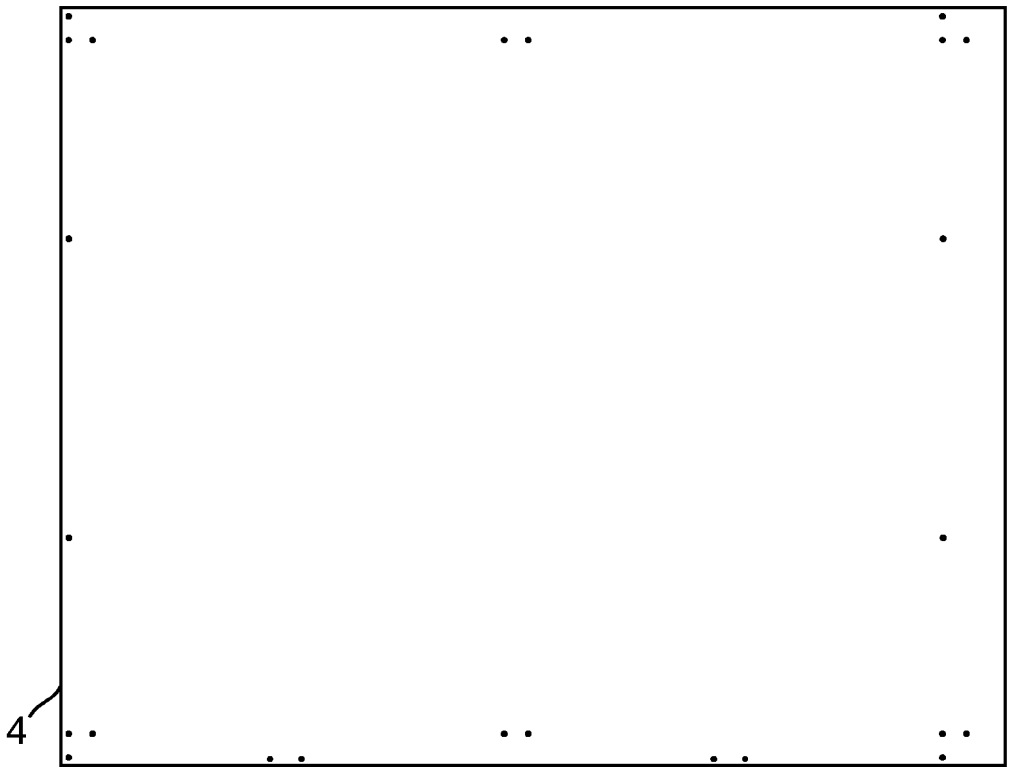
Figure 2C:
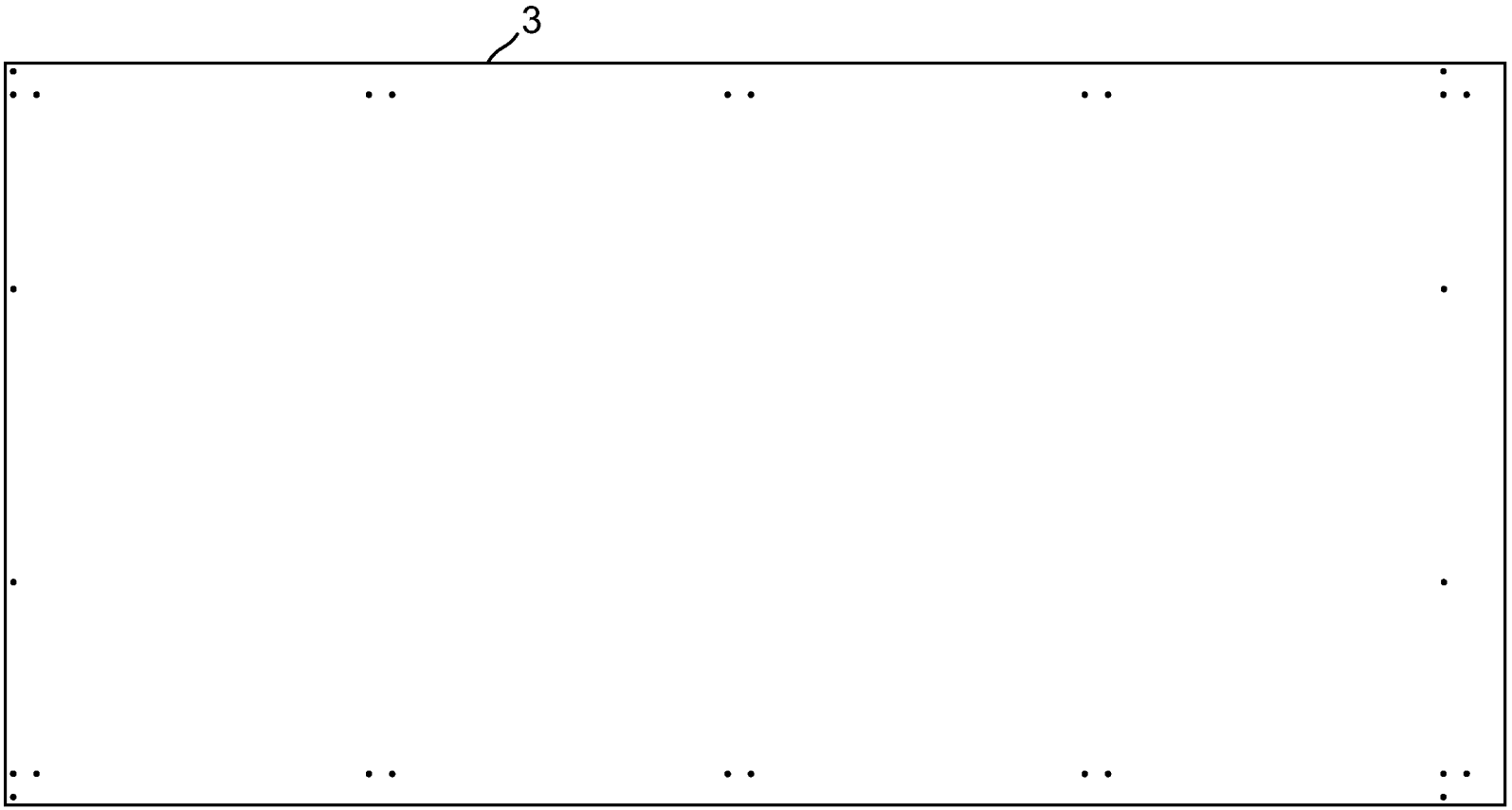
Figure 2D:
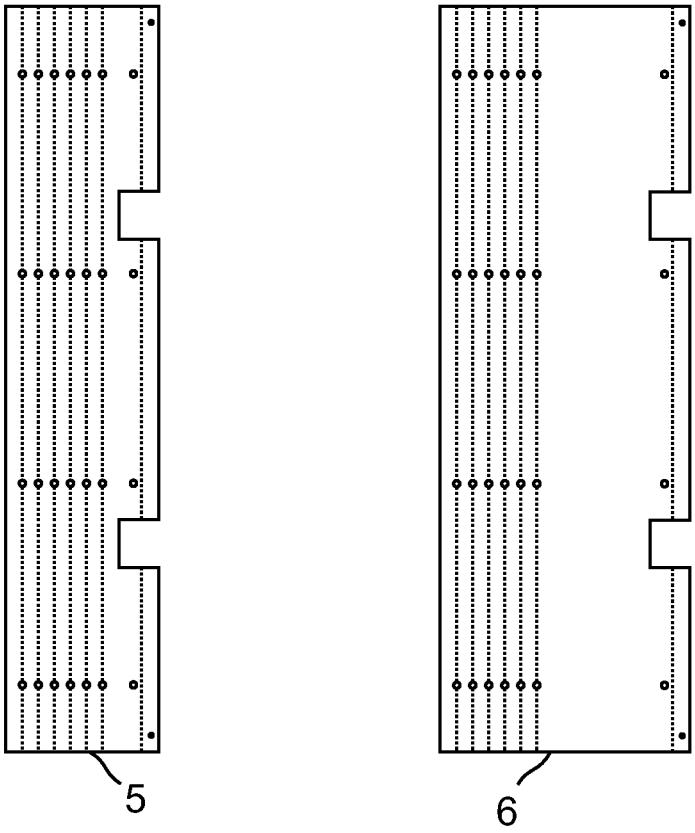

FIG. 1 illustrates one example of an implementation of the present invention. Cylindrical advertising displays such as 1 are mounted on respective light poles. A support structure is provided in conjunction with each display to support each display on a respective pole.

FIG. 2 illustrates building blocks of one embodiment of an advertising system according to the present invention. The basic component is a printed sheet of predetermined dimensions. In FIG. 2A-2C, sheets 2, 3 and 4 are all example diagrams of sheets that may be used according to the present invention. Each of sheets 2, 3 and 4 include a pattern of holes that are explained in more detail below and that serve in securing the respective sheet to a corresponding support structure. Side views of example support structures, which will be explained in more detail below, are illustrated as reference numerals 5 and 6.

Figure 3:
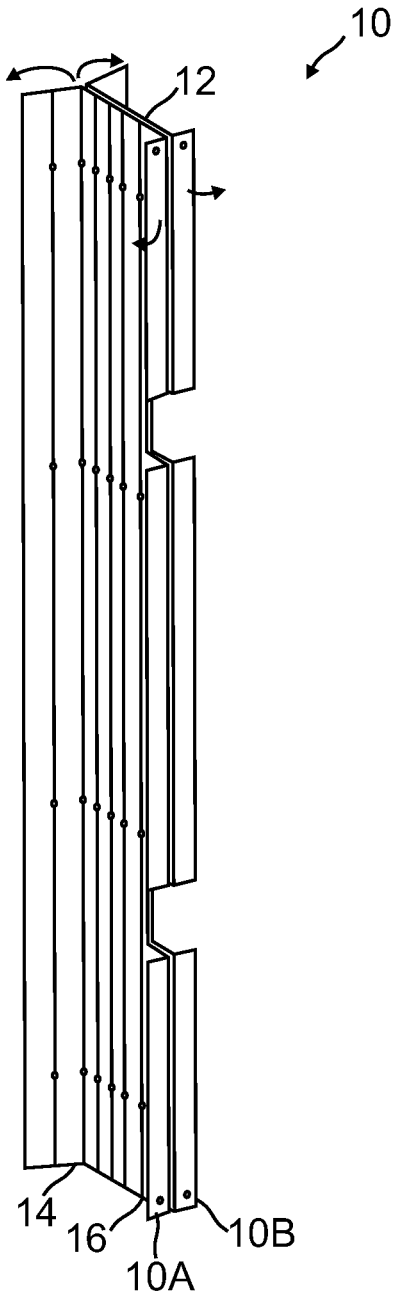
FIG. 3 illustrates a support panel according to the present invention.

Considering now the support structure in detail, and referring to FIG. 3, support panel 10 is a panel having two parts 10A and 10B. The parts 10A and 10B are secured together using, for example, Viking clips. The panels have score lines 12 extending the length of the panel at predetermined intervals along the width of the panel, which allow the panel to be configured for a particular diameter of supporting pole, post or the like. Particular score lines are used as fold lines. The particular score line that is used as a fold line depends upon the diameter of the central support.

Figure 4:
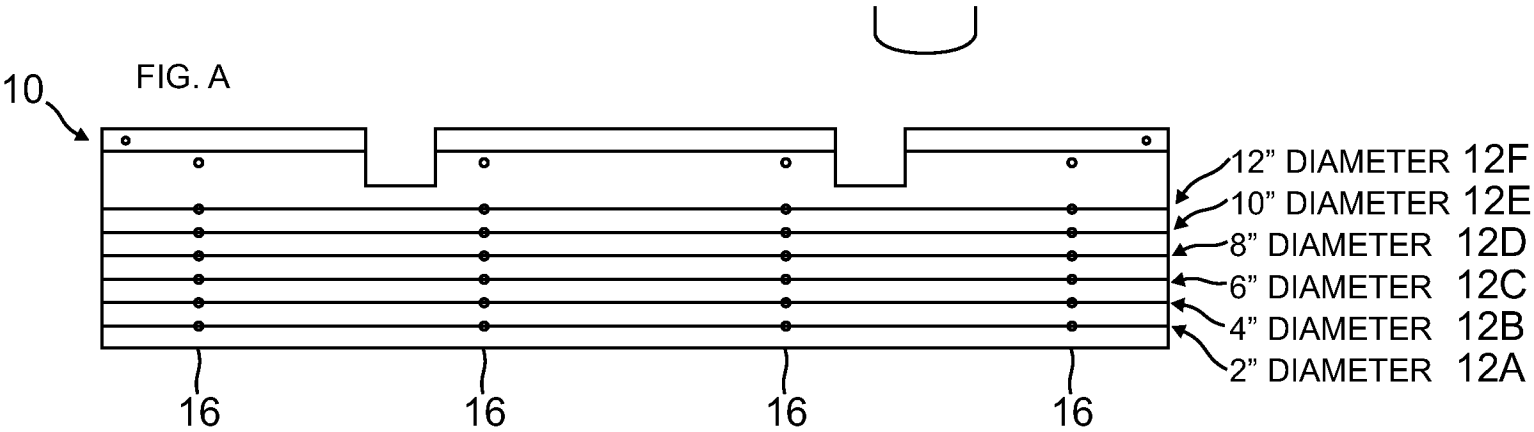
FIG. 4 is a side view of the support panel of FIG. 3.

For example, with a central support having a large diameter, a score line may be chosen to be a fold line fairly near to the edge 14 of the panel 10. On the other hand, for a central support having a narrow diameter, a score line may be selected nearer to the edge 16 of the panel 10. FIG. 4 illustrates the panel 10 in more detail. Several score lines 12A, 12B, 12C, 12D, 12E and 12F are illustrated.

In one embodiment, score line 12A is used as a fold line when a post (FIG. 4) is 2 inches in diameter. Fold line 12B would be used when the post is 4 inches in diameter, while fold line 12C would be used when the post is 6 inches in diameter. Fold line 12D would be used for a 8 inch diameter pole, 12E would be folded for a 10 inch diameter pole, and for a very large pole of 12 inches, 12F would be the fold line.

The two panels 10A and 10B are secured together at apertures 16, such as by Viking clips. In use, Viking clips are unscrewed and removed as appropriate in order to free up the panels to fold at the appropriate location. Securing means other than Viking clips may alternatively be used.

Figure 5:
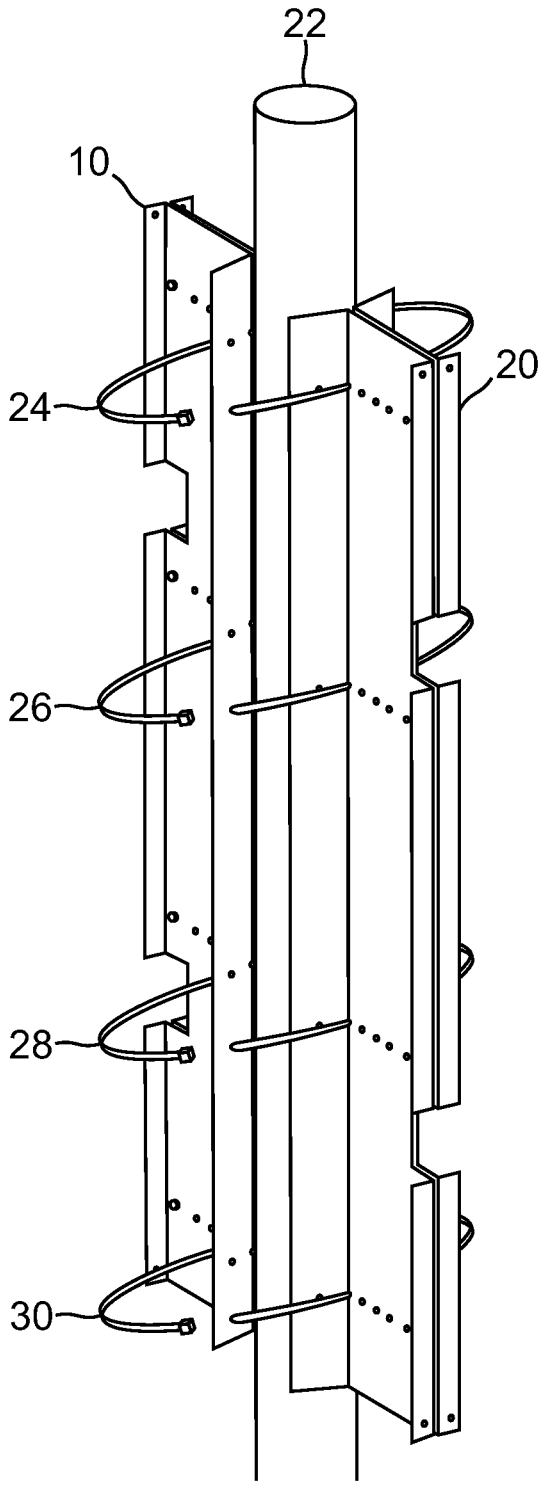
FIG. 5 illustrates a support assembly being secured to a post.

FIG. 5 illustrates two sets of panels 10 and 20, with one set of panels on each side of a pole 22. In this specific non-limiting example, the pole has a diameter of 2 inches, and the panels have been folded appropriately to correspond to a 2 inch diameter pole. Once the panels 10 and 20 are placed on opposite sides of the pole 22, zip ties are inserted through holes in each of the panels 10 and 20. The pointed end of the zip tie is inserted into the receiving end of the zip tie and the strap is pulled tight to lock the panels in place. Any excess strap may be cut off so as to prevent excess material. The zip ties are represented by reference numerals 24, 26, 28 and 30. It is to be understood that more or fewer zip ties may be used in a particular application.

Figure 6:
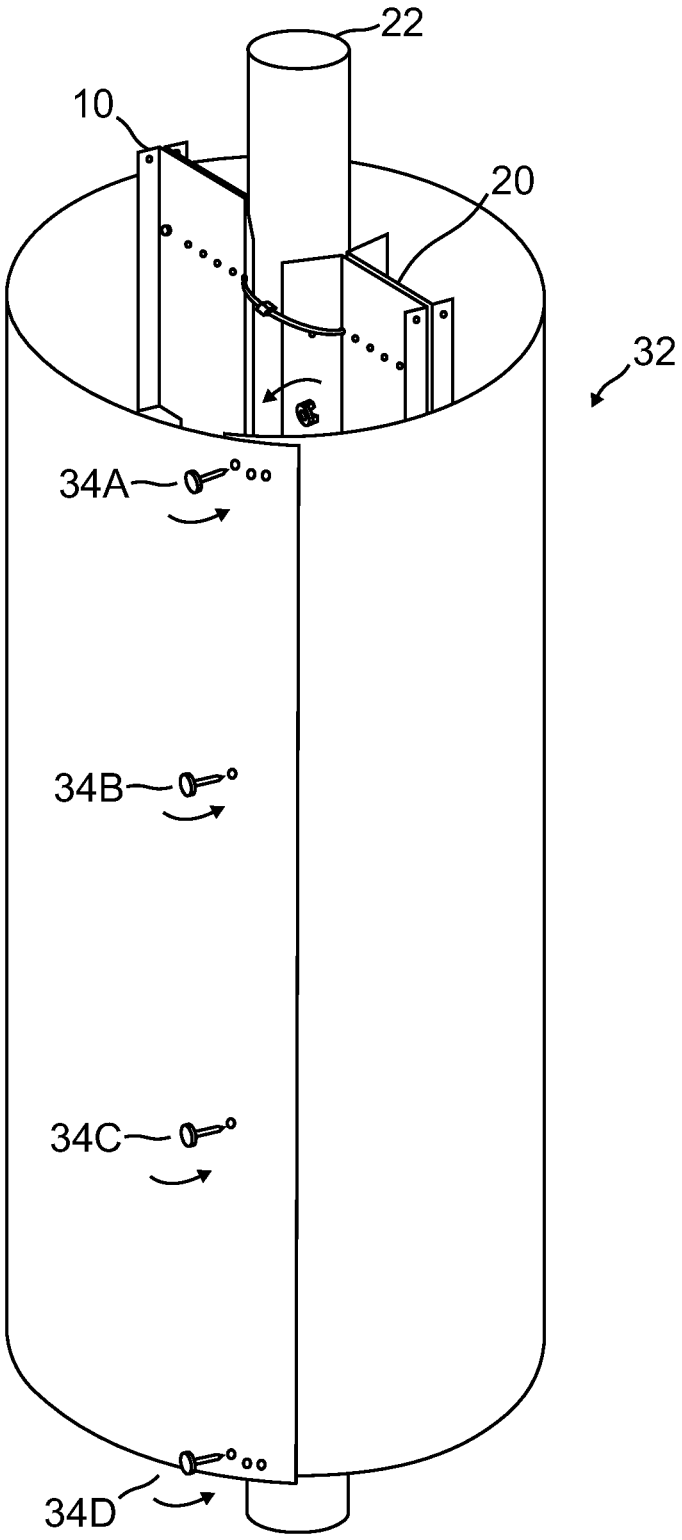
FIG. 6 illustrates a sheet wrapped around a pole and support panels.
Figure 7:
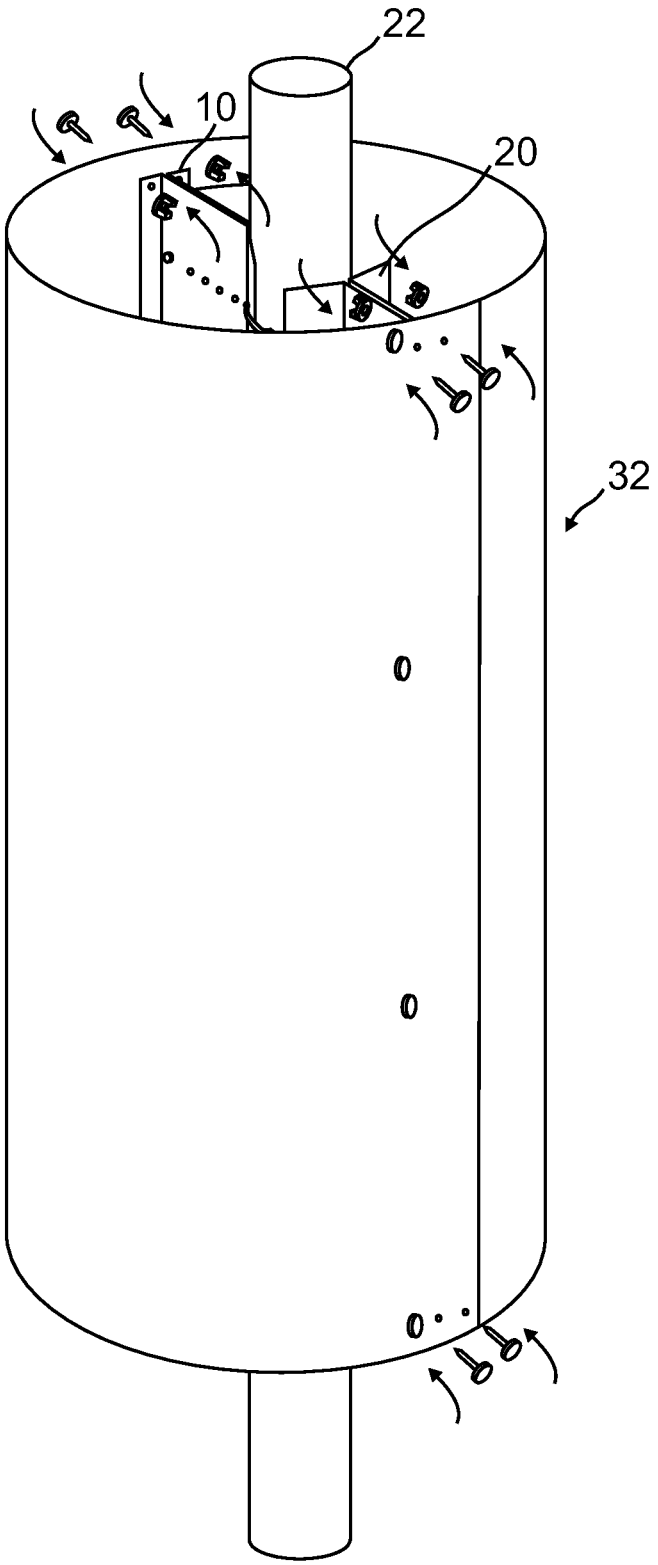
FIG. 7 illustrates the wrapped sheet having been rotated and lifted up to be secured onto the support panels.

Referring now to FIG. 6, a cylindrical sign 32 is wrapped about the panels 10 and 20. The sign 32 is secured into its cylindrical configuration with Viking clips 34A, 34B, 34C and 34D. At this point, the cylindrical sign 32 is a wrap. The wrap is lifted and rotated if necessary (FIG. 7). Holes in the wrap are aligned with corresponding holes in the panels 10, 20. Viking clip screws are inserted through the holes and then secured onto the wrap with corresponding wing nuts from the inside of the cylindrical sign 32. This step is repeated on the lower holes on the wrap 32, to secure the wrap to the supporting panels 10, 20. The wrap may have multiple sets of holes for a particularly secure fit, as desired.

Figure 8:
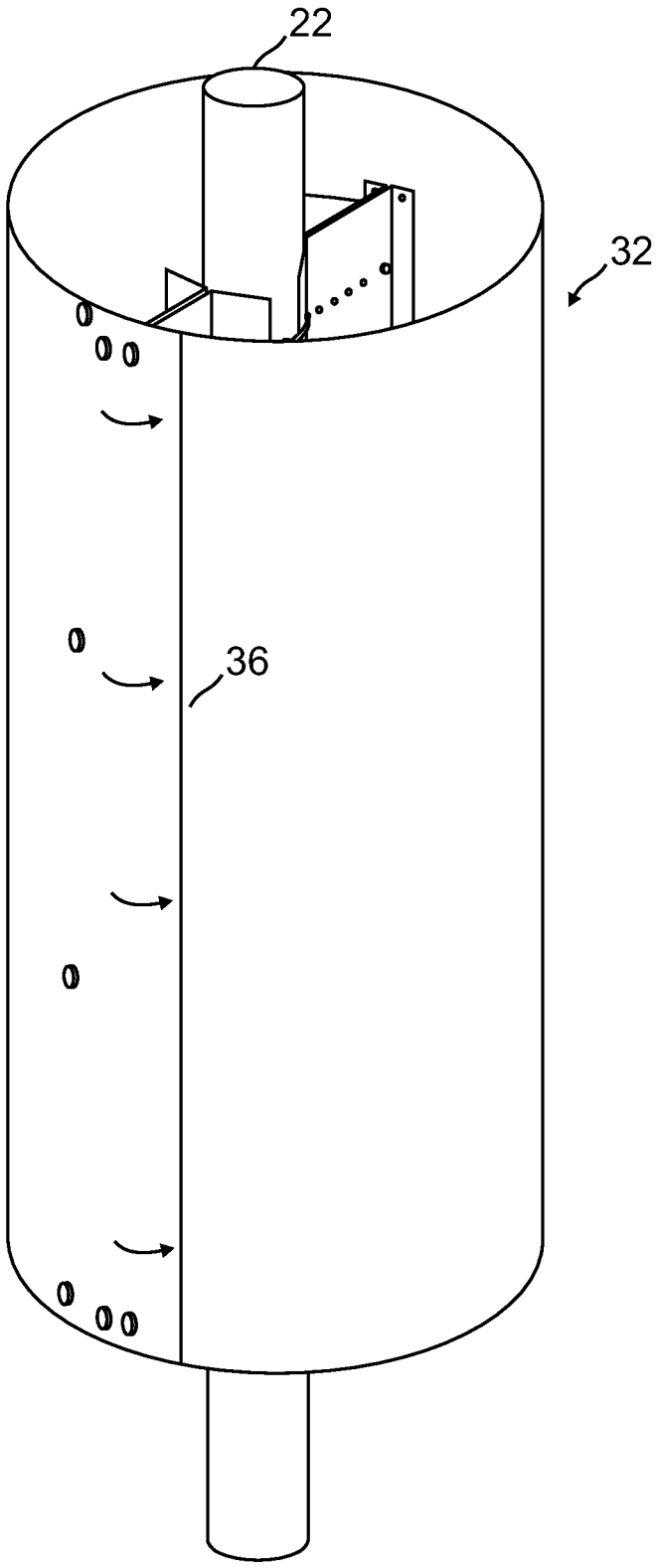
FIG. 8 illustrates the display as fully assembled and secured to the support panels.

FIG. 8 illustrates the cylindrical wrap in a secured configuration. The seam at which the wrap is wrapped 36 may optionally be covered with a strip of tape, if desired. Alternatively, adhesive may be applied to the interior of the wrap itself along the edge, such that the assembly is self adhering. Or, the adhesive along an edge of the wrap may be covered with a release liner that the user removes when securing the edges of the wrap 32 together in the final step.

The foregoing display unit can be utilized on a variety of supports 22, such as poles, trees, rectangular shaped posts, or any of a wide variety of other supports. As a non-limiting example, for a display unit of 18 inches diameter, for example, the support size may typically range from 2 inches up to 12 inches. In one embodiment, the height of 18 inch diameter unit is 48 inches. This unit utilizes two panel extenders at 180° of rotation.

For a larger wrap unit, a pole size might range from between 2 inches up to 12 inches while the diameter of the display unit is 30 inches. In this particular embodiment, which is non-limiting and is presented only for purposes of example, the height of the panel is 58 inches. This larger unit may use more than 2 panel extenders, such as 10 and 20 in FIG. 3. It is possible for a large unit to use a greater number of support panels (not shown) such as 3 or 4 or more, depending upon the size of the display unit and other factors. Again, the support can be round, square or any other shape, and may be used on trees. It is also noted that typically the display unit will have a vertical orientation. However, in some applications the orientation may be at an angle or may be horizontal, depending on the orientation of the support and the orientation desired.

In one embodiment, the display panels are screen printed panels on which the screen printing has been applied directly to 0.030 super opaque styrene. The styrene is dye cut to size per predetermined dye lines. Typically the units are held together in the cylindrical configuration with tape that is double-sided permanent tape. However, as can be imagined, many different adhesive types and configurations can be used. In one embodiment, the double-sided tape is 1/32" thick.

Concerning support panels, there will usually not be ad printing on support panels as they are not visible to the outside viewer. These interior support panels are dye cut per predetermined specification. In one embodiment, 4 mm wide coroplast may be used for the support panels. As noted above, one type of securing unit is the Viking clip and, in one specific embodiment, 16 Viking clips are used in total on the assembly. However, this specific number can vary greatly depending on the application and configuration of the display unit.

Figure 9:
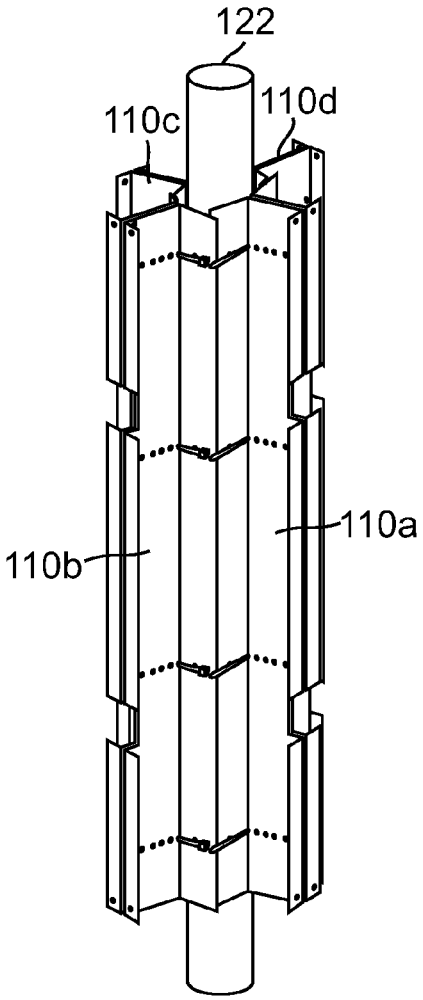
FIG. 9 illustrates a support structure for an alternative embodiment square advertising display.
Figure 10:
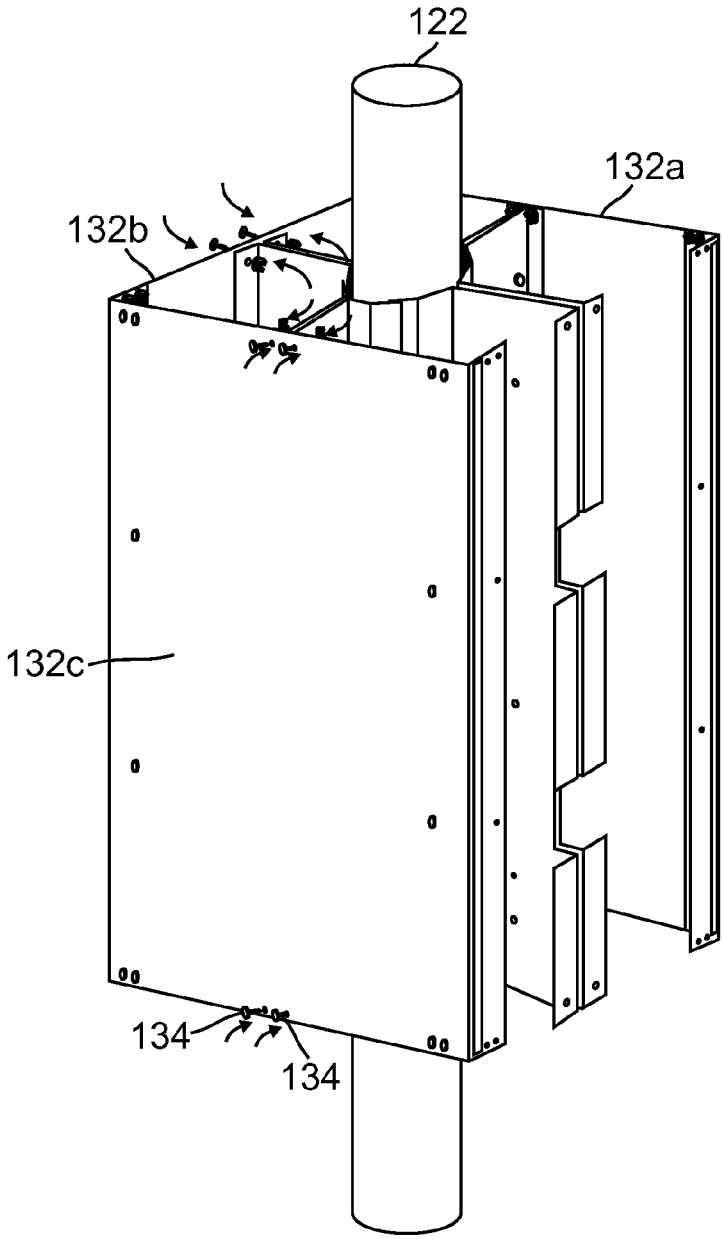
FIG. 10 illustrates rectangular panels being installed on the support structure of FIG. 9.

FIG. 9 illustrates a support assembly including a support members 110. These support members are similar to the support members illustrated in for example FIG. 6. However, the configuration of FIG. 9, there will be four support structures 110*a-d* which, in turn, will support four rectangular panels 132*a-d* (FIG. 10). Each support panel 110 is attached to a respective display panel 132 by way of screws, nuts, bolts, Viking clips or other fasteners. Typically apertures are provided in both the support structure and the display panels in order to facilitate the mounting.

Figure 11:
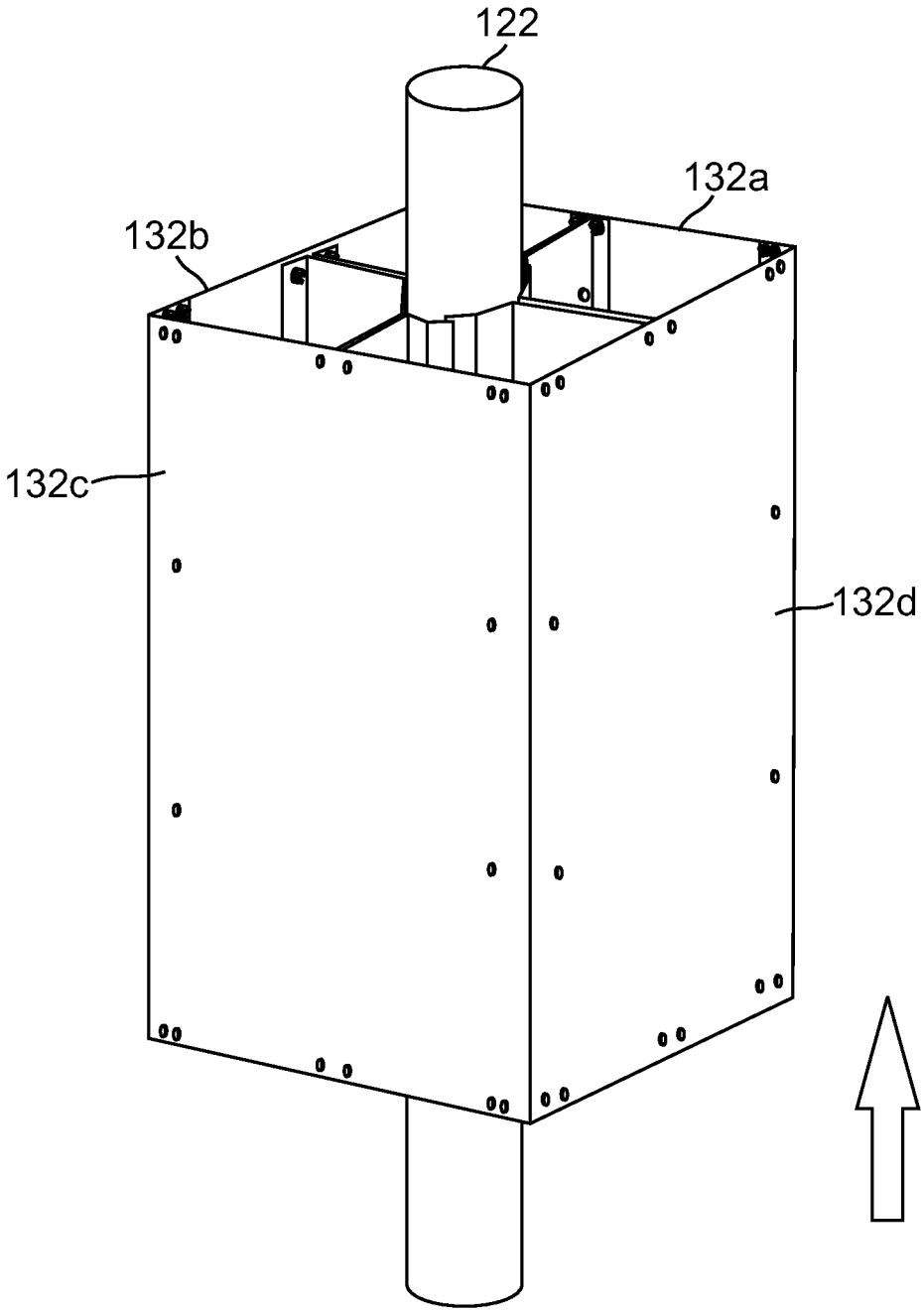
FIG. 11 illustrates a square advertising display constructed and being moved upwardly into place on a central pole.

FIG. 11 illustrates a completely assembled rectangular advertising display, arranged about the central pole 122. In FIG. 11, the assembly has been fully assembled, however the assembly may be pushed upwardly into position for viewing on the pole.

Figure 12:
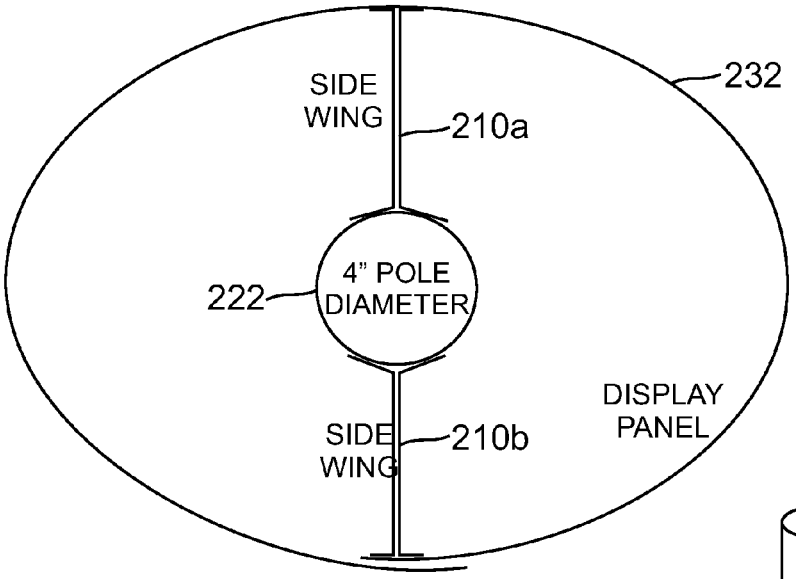
FIG. 12 is a top view of an oval embodiment of the present invention.

Considering FIG. 12, the advertising display may take still other shapes. For example, in FIG. 12 the display panel has an oval shape. Two support structures 210*a, b*, as previously illustrated, are utilized. Each support structure supports a minor edge of the display panel 232, which then extends about pole 222.

Figure 13:
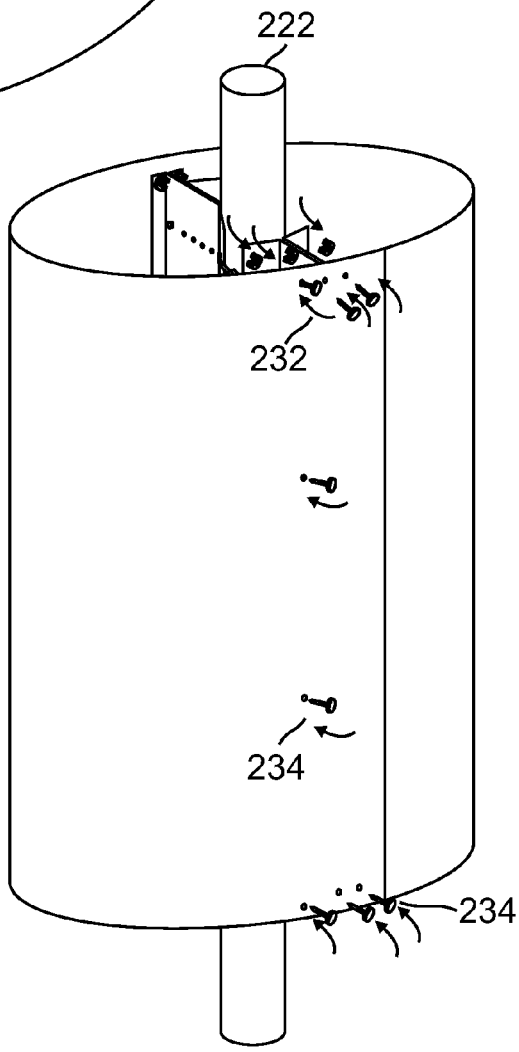
FIG. 13 illustrates a panel being wrapped about a support structure to form the oval embodiment of FIG. 12.
Figure 14:
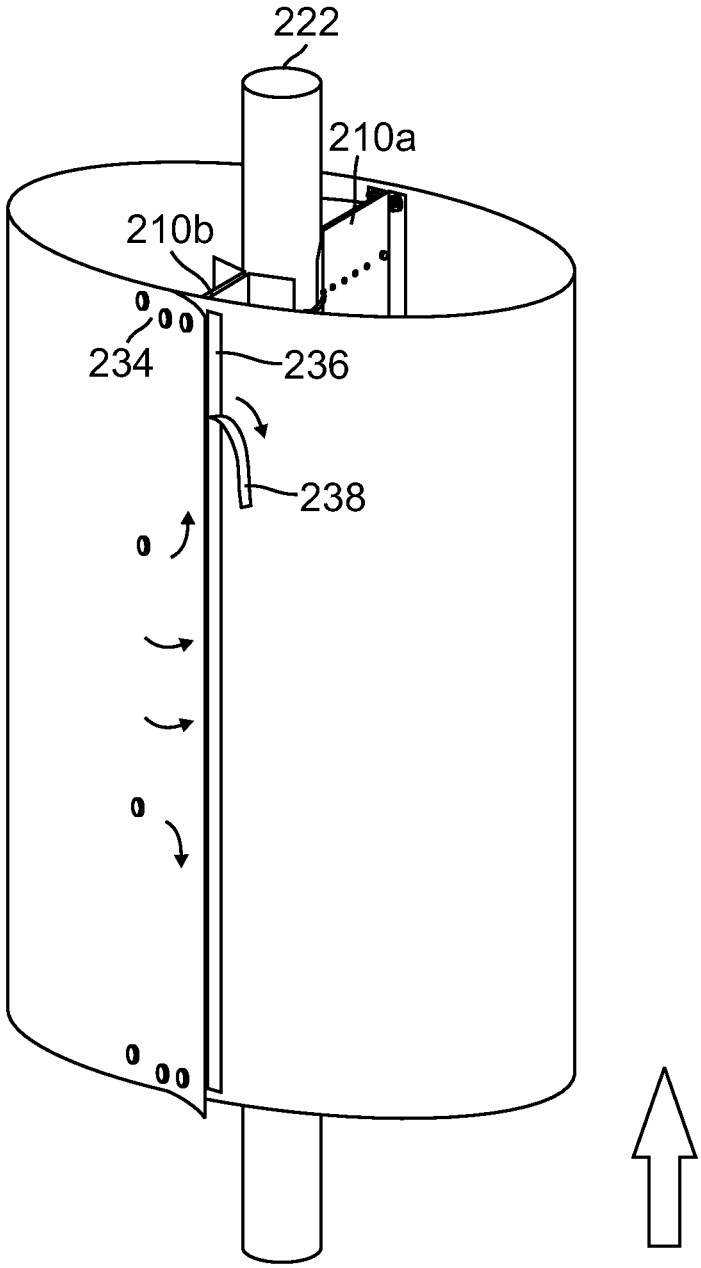
FIG. 14 illustrates final assembly of the oval embodiment of FIG. 12.

FIG. 13 illustrates a display panel sheet 232 being wrapped about the support structures and secured thereto using nuts, bolts, screws 234 or the like. Considering FIG. 14, the very end of the display panel may be secured back upon the display panel using double sided tape, for example. In FIG. 14, a strip of double sided tape 236 is shown with the backing 238 being removed, so that the very end of the panel may be secured thereto.

Figure 15:
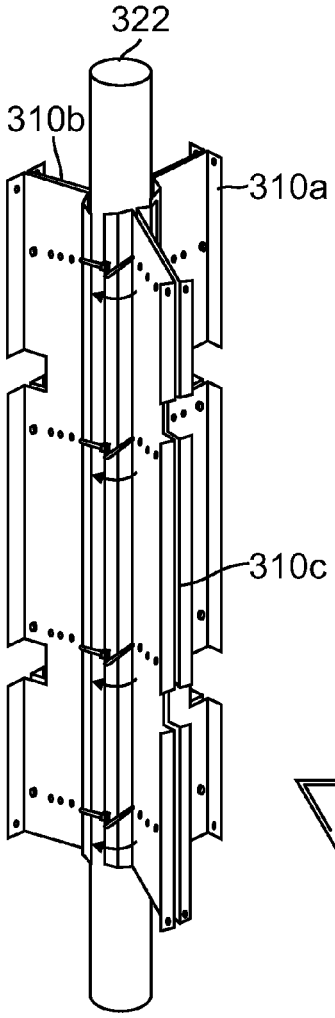
FIG. 15 illustrates a support structure for a triangular embodiment of the present invention.
Figure 16:
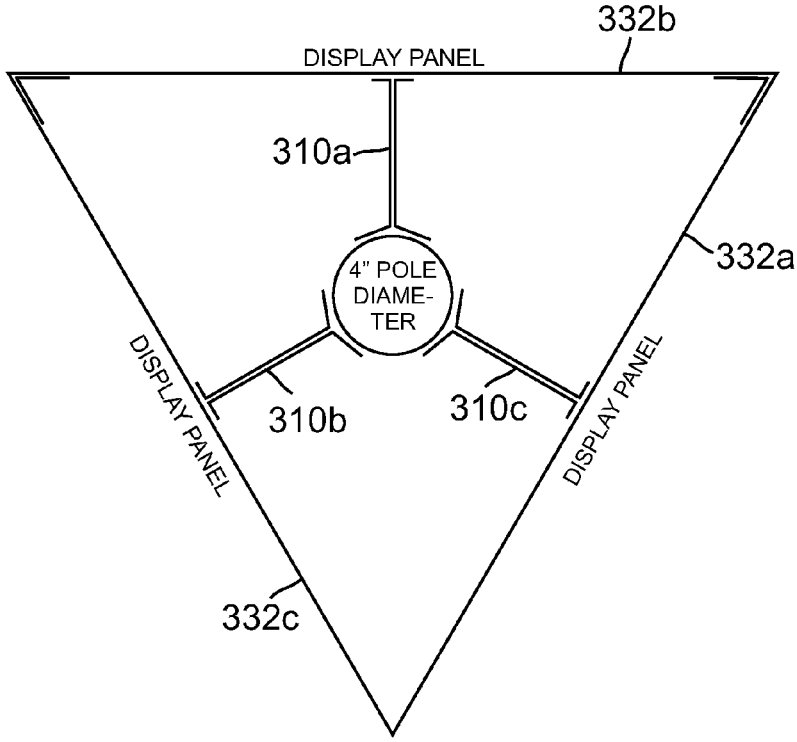
FIG. 16 is a top view of a support and display panel assembly of the embodiment of FIG. 14.

Now considering a triangular sign or display embodiment, FIG. 15 illustrates a three support system. Each support structure supports 310*a-c* one panel 332*a-c* of the triangular display. As seen in FIG. 16, for example, the support structures may support the display panels at approximately the center of each display panel.

Figure 17:
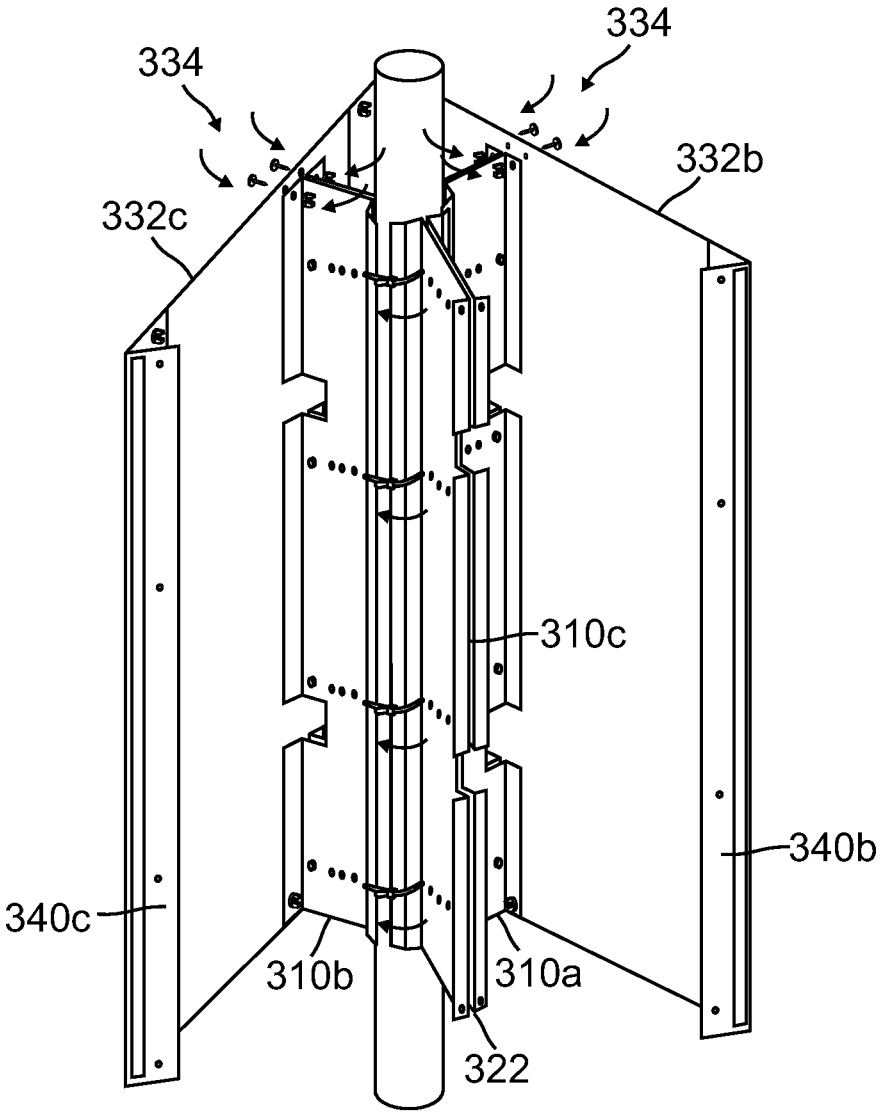
FIG. 17 is a partially-assembled view illustrating two of the three panels of the embodiment of FIG. 15.
Figure 18:
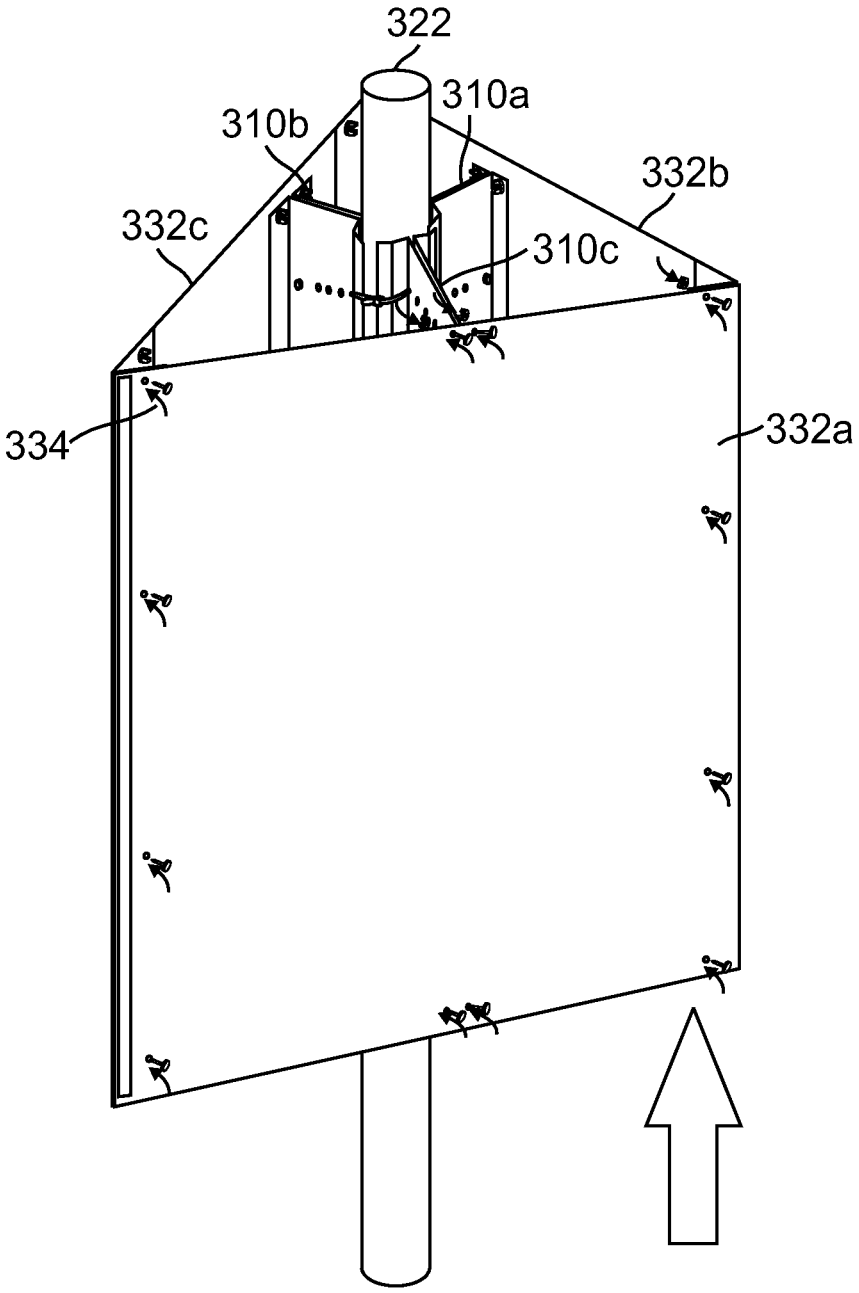
FIG. 18 illustrates the triangular embodiment of FIG. 15 fully assembled and being pushed into position on a pole.

FIG. 17 shows the triangular assembly with one panel removed so that the supporting system 310*a-c* may be seen. To complete the display of FIG. 17, an additional panel would be secured into place. FIG. 18 thus illustrates the final steps in assembling the triangular display assembly. The final display panel is screwed into place both on the support structures and on the extending tabs of the adjacent panels. The extending tabs 340*b, c* of the adjacent panels may be seen, for instance, in FIG. 17.

Figure 19:
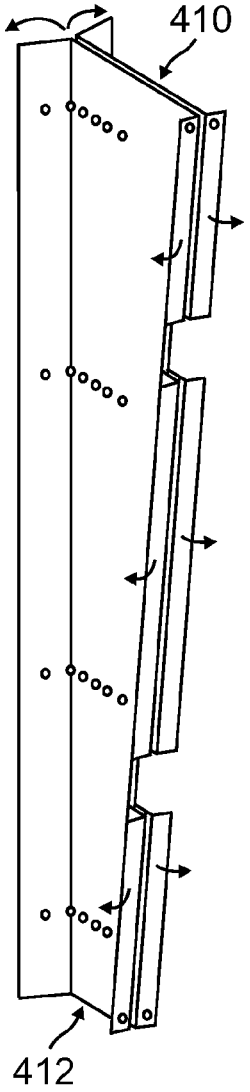
FIG. 19 illustrates a support member of the support structure for a tapered version of the present invention.
Figure 20:
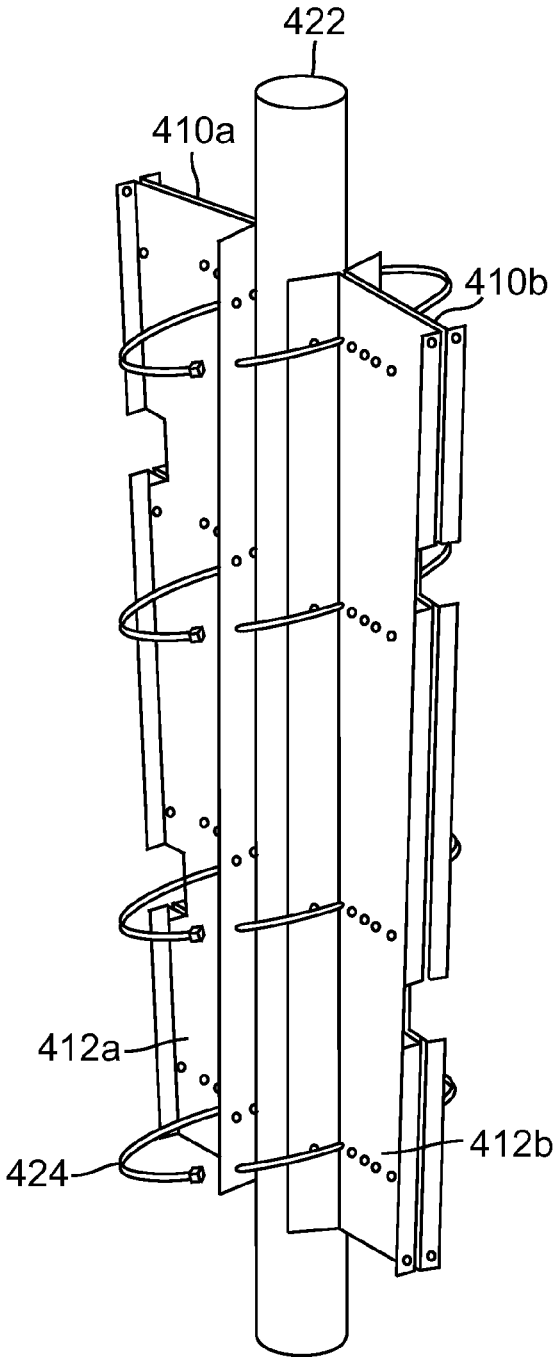
FIG. 20 illustrates securing two tapered support structures as shown in FIG. 19 to a pole.
Figure 21:
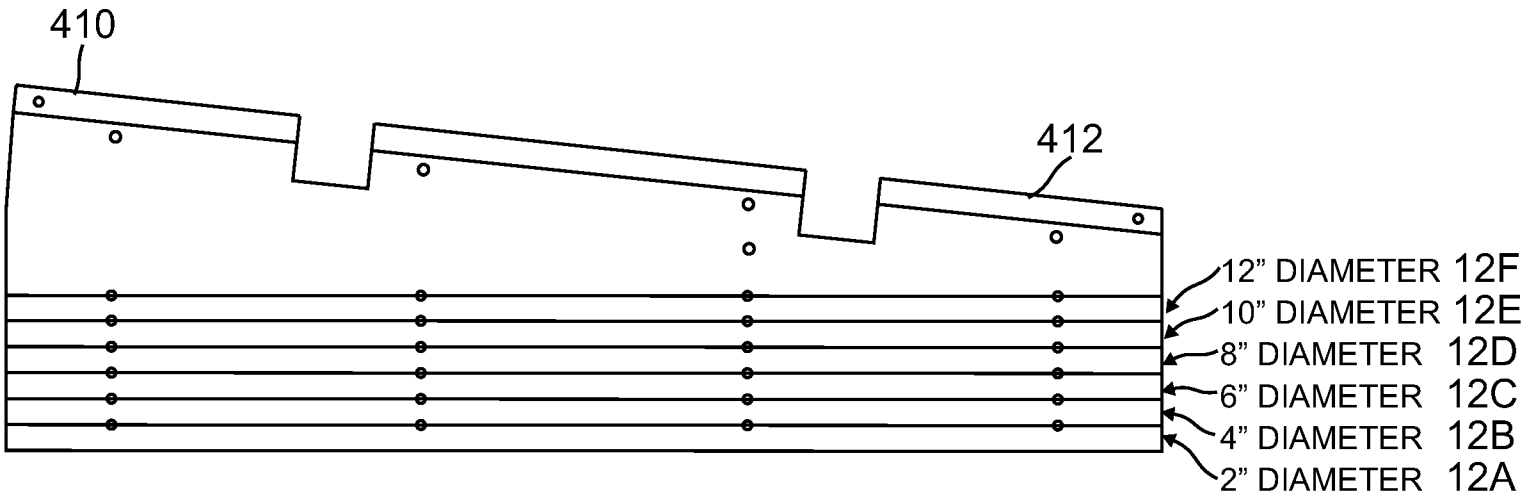
FIG. 21 illustrates a support structure panel having a plurality of score lines for adjusting the support to the corresponding pole diameter.

It may be desired in some circumstances to have a tapered display. So, for instance, FIG. 19 shows a tapered support structure having wide end 410 and 412, FIG. 20 shows two tapered support structures mounted by way of plastic straps 424 onto a respective pole 422. As discussed previously, the pole may be of any of a number of diameters. Consequently, the support cut out shown in FIG. 21 that is used to form the support structures has a number of different score lines, corresponding to different pole diameters. The score lines 412A-F may be chosen based upon which diameter of pole is to be used.

Figure 22:
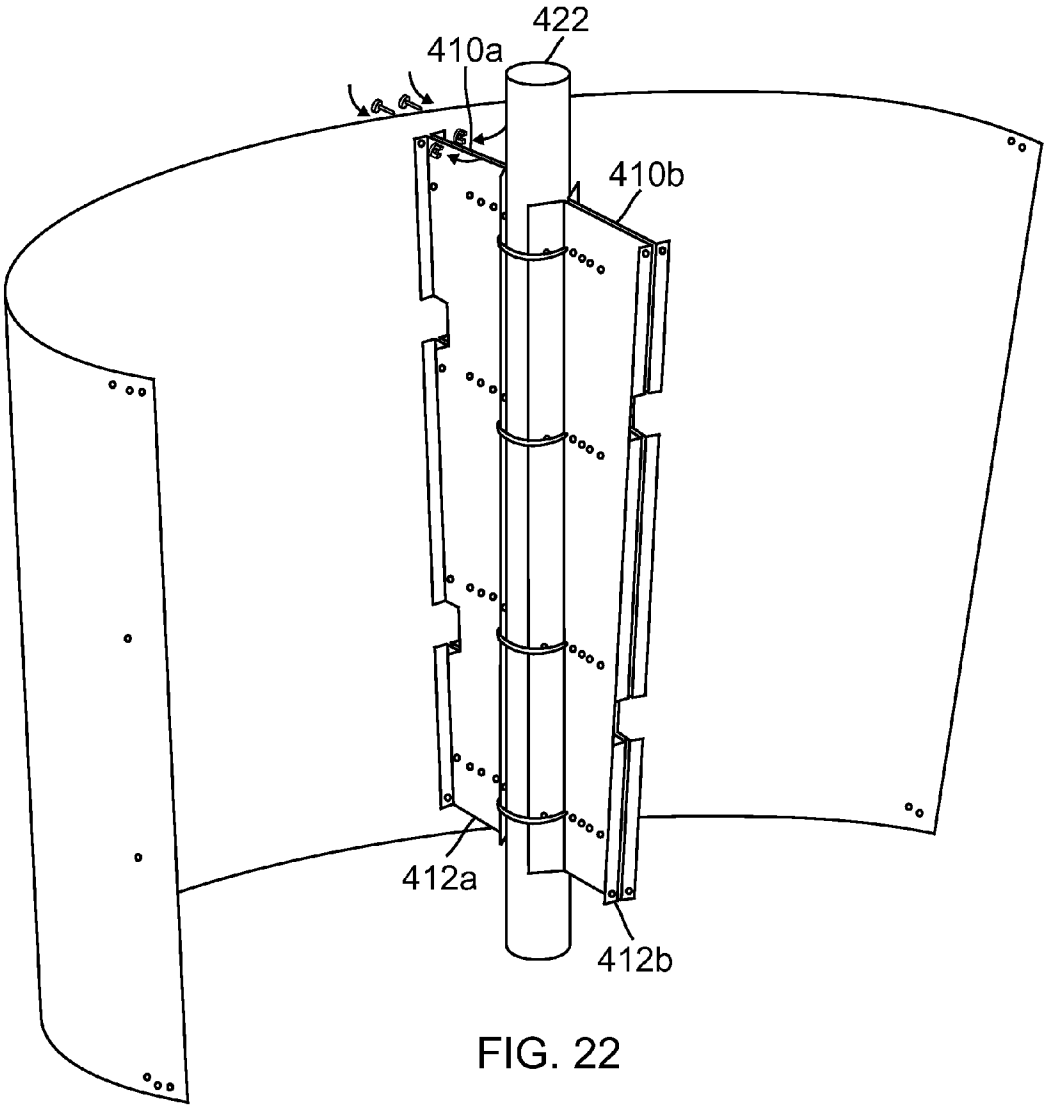
FIG. 22 illustrates wrapping display panel about a tapered support structure.
Figure 23:
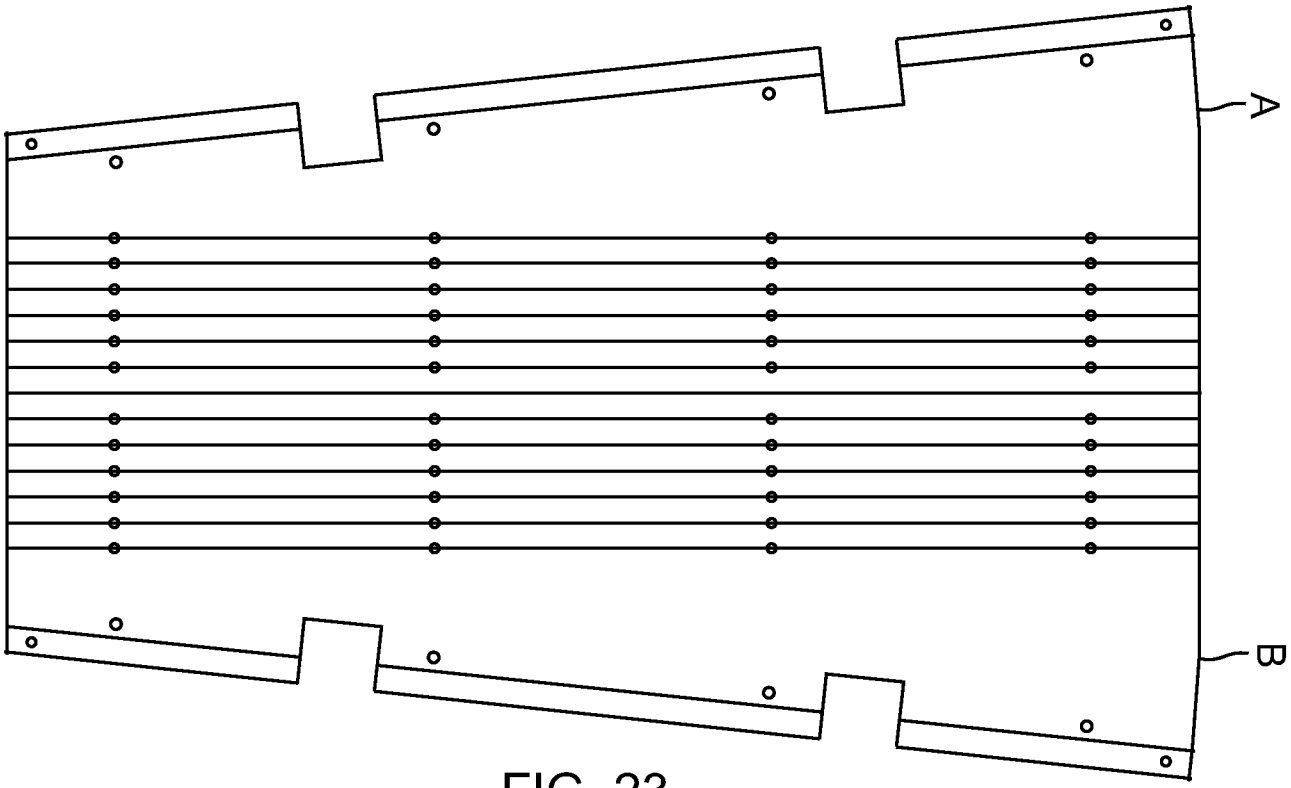
FIG. 23 illustrates a double support panel cut-out from which two support panels can be constructed.
Figure 24:
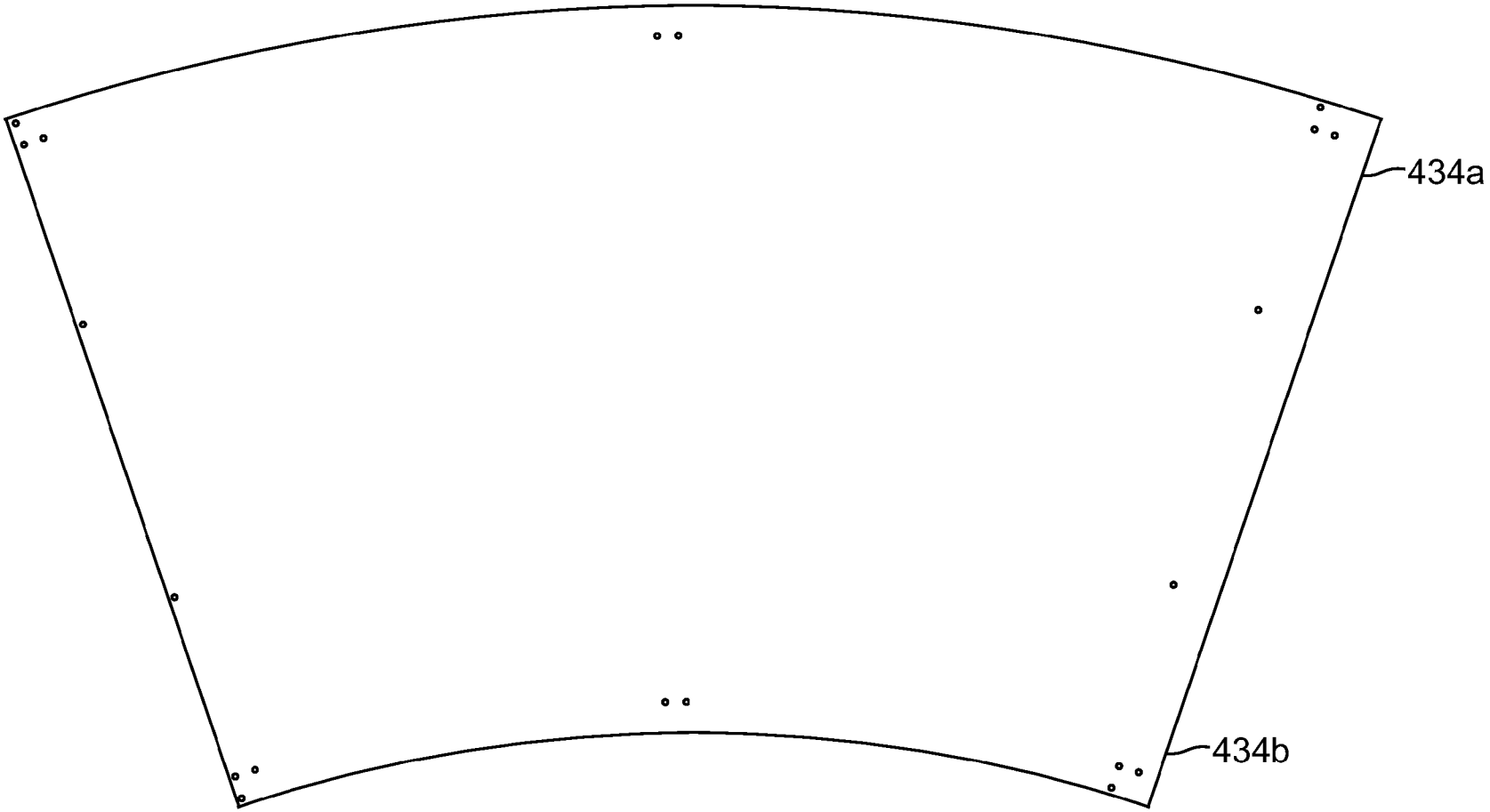
FIG. 24 illustrates a display panel for forming the tapered display of FIG. 22.

FIG. 22 illustrates the process of wrapping a tapered display panel about the support structure to form the tapered display. FIG. 23 illustrates an efficient way to manufacture the support structure FIG. 21, for example by creating two support structures, A and B, out of a single sheet. After the single sheet of FIG. 23 is cut, for example, it may be cut again down the middle to form the two separate support structures. FIG. 24 is an illustration of the display panel utilized in FIG. 22. The display panel FIG. 24, for instance, has a narrower bottom end 434*b* than top end 434*a*, allowing the display to be tapered downwardly. In other embodiments, the narrow end may be the top of the display for example with the wider end being at the bottom of the display. In that case, the taper flares the opposite direction, so that the wider portion is at the bottom of the display and the narrower portion is at the top of the display.

It will be apparent from the foregoing that, while particular forms of the invention have been illustrated and described, various modifications can be made without parting from the spirit and scope of the invention. For example, the display need not always be cylindrical, but may alternatively be other shapes, such as triangular, square, rectangular, or other cross sections depending on the configuration desired. Other variations may be made within the scope of the invention. Consequently, the invention is not limited to the foregoing illustrated embodiments, which are presented for purposes of illustration and not of limitation.

What is claimed is:

1. An advertising display system for mounting on a primary support, the display comprising;

a first display support;

a second display support;

at least one flexible, adjustable tie to secure the first and second supports to the primary support;

an advertising panel, the advertising panel mounted on and secured to the first and second display supports and extending around the primary support;

wherein the display supports space the advertising panel a distance from the primary support, each display support being formed from a sheet of material and being foldable in a folding area of the display support, each display support having a plurality of markings to indicate fold lines to accommodate a variety of primary support sizes;

wherein the advertising panel extends about the display supports to form one of a cylindrical and an oval advertising display.

2. An advertising display system as defined in claim 1, wherein the markings on the display supports are fold lines.

3. An advertising display system as defined in claim 1, wherein the advertising panel and the display supports comprise a polyvinyl chloride (pvc).

4. An advertising display system as defined in claim 1, wherein the advertising panel and the display support are formed from at least one sheet of material.

5. An advertising display system as defined in claim 1, wherein the at least one sheet of material is a pvc material.

6. An advertising display system as defined in claim 1, wherein the system further comprises mechanical fasteners for fastening the advertising panel to the display supports.

7. An advertising display system as defined in claim 1, wherein the system further comprises adhesive to secure a first end of an advertising panel to a second end of the advertising panel.

8. An advertising display system as defined in claim 1, wherein visual information is printed on the advertising panel.

9. An advertising display system as defined in claim 1, wherein the advertising panel is tapered, having a wider dimension on one end and a narrower dimension on an opposite end.

10. An advertising display system as defined in claim 9, wherein at least one display support is tapered, having a wider dimension on one end and a narrower dimension on an opposite end.

11. An advertising display system for mounting on a primary support, the display comprising;

advertising panel means;

display support means for supporting the advertising panel means about the primary support;

means for securing the display support means to the primary support;

means for securing the advertising panel means to the display support means;

means for adjusting at least one dimension of the display support means to adjust spacing of the advertising panel means from the primary support;

wherein the display support means for supporting the advertising panel means about the primary support comprises at least one support formed from a sheet of material.

12. An advertising display system as defined in claim 11, wherein the advertising panel means comprises at least one printed panel.

13. An advertising display system as defined in claim 11, wherein the means for securing the display support means to the primary support comprises a flexible, adjustable band.

14. An advertising display system as defined in claim 11, wherein the means for securing the advertising panel means to the display support means comprises at least one of screws, bolts, Viking clips, glue, adhesive, heat bonding, and hook-and-loop fasteners.

15. An advertising display system as defined in claim 11, wherein the means for adjusting at least one dimension of the display support means to adjust spacing of the advertising panel means from the primary support comprises a plurality of fold lines.

16. An advertising display system as defined in claim 11, wherein the advertising panel means and the display support means are formed from sheet material.

17. An advertising display system for mounting on a primary support, the display comprising;

a first display support;

a second display support;

at least one flexible, adjustable tie to secure the first and second supports to the primary support;

an advertising panel, the advertising panel mounted on and secured to the first and second display supports and extending around the primary support;

wherein the display supports space the advertising panel a distance from the primary support, each display support being formed from a sheet of material and being foldable in a folding area of the display support, each display support having a plurality of markings to indicate fold lines to accommodate a variety of primary support sizes;

wherein the advertising panel comprises first, second and third subpanels, the system further including a third display support, the first, second and third subpanels being respectively secured to the first, second and third subpanels to form a triangular advertising display.

18. An advertising display system for mounting on a primary support, the display comprising;

a first display support;

a second display support;

at least one flexible, adjustable tie to secure the first and second supports to the primary support;

an advertising panel, the advertising panel mounted on and secured to the first and second display supports and extending around the primary support;

wherein the display supports space the advertising panel a distance from the primary support, each display support being formed from a sheet of material and being foldable in a folding area of the display support, each display support having a plurality of markings to indicate fold lines to accommodate a variety of primary support sizes;

wherein the advertising panel comprises first, second, third and fourth subpanels, the system further including third and fourth display supports, the first, second, third and fourth subpanels being respectively secured to the first, second, third and fourth subpanels to form a rectangular advertising display.

* * * * *